United States Patent [19]

Jimenez et al.

[11] 4,159,005

[45] Jun. 26, 1979

[54] THREAD-TENSIONING DEVICE, PARTICULARLY FOR SEWING MACHINES

[75] Inventors: Antonio Jimenez, Meyrin; Olindo Baruffa, Thonex, both of Switzerland

[73] Assignee: Mefina S.A., Fribourg, Switzerland

[21] Appl. No.: 750,826

[22] Filed: Dec. 15, 1976

[30] Foreign Application Priority Data

Dec. 24, 1975 [CH] Switzerland ..... 16765/75

[51] Int. Cl.[2] ..... D05B 47/02

[52] U.S. Cl. ..... 112/254

[58] Field of Search ..... 112/254, 255, 59, 97; 242/149, 150 R

[56] References Cited

U.S. PATENT DOCUMENTS 3,366,083 1/1968 Ketterer et al. ..... 112/254

3,927,631 12/1975 Kuhar ..... 112/254

FOREIGN PATENT DOCUMENTS 2157016 5/1973 Fed. Rep. of Germany ..... 112/254

559780 5/1957 Italy ..... 112/254

*Primary Examiner*—George H. Krizmanich

*Attorney, Agent, or Firm*—Emory L. Groff, Jr.

[57] ABSTRACT

A thread-tensioning device of a sewing machine comprises thread-squeezing plates between which the thread passes. A shaft applying pressure to the plates is subjected to the action of a transmission lever which is acted upon by a spring-urged ball which is moved by a control button along an arcuate path from adjacent the pivoting axis of the lever to near an end of the lever. The angle of the lever can be set to enable progressive setting of the thread tension for a constant spring pressure, or with variation of the spring pressure.

16 Claims, 8 Drawing Figures

FIG.4
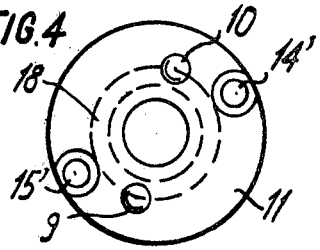
FIG.7
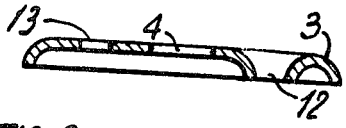
FIG.5
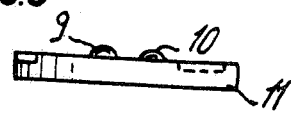
FIG.6
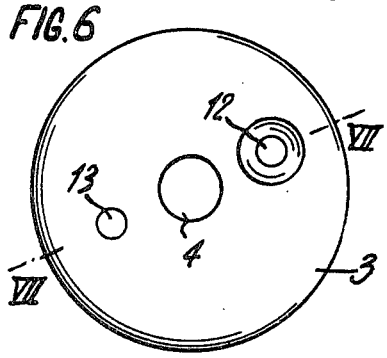
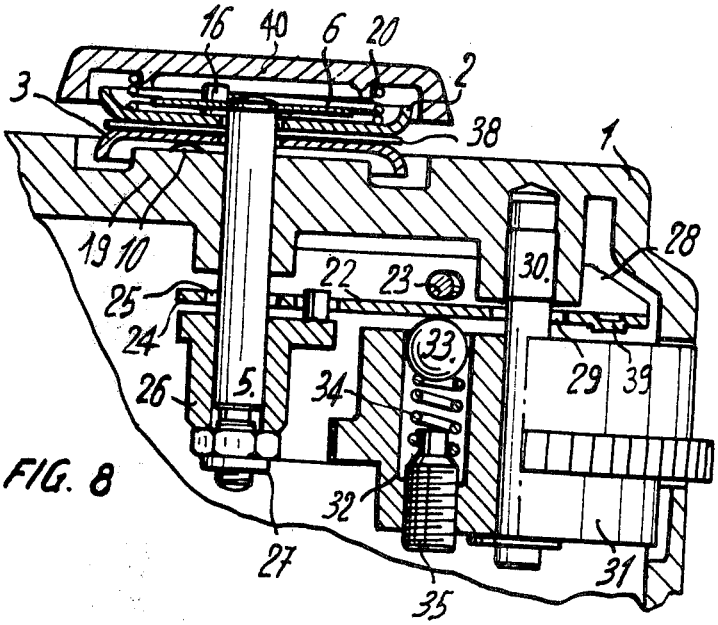
FIG. 8

THREAD-TENSIONING DEVICE, PARTICULARLY FOR SEWING MACHINES

The invention relates to devices for regulating the tension of a thread, of the type comprising at least two thread-squeezing plates disposed on a shaft and a control member ensuring clamping together of the plates.

Known devices of this type are usually submitted to the action of a spring the force of which is directly regulated by the control member. However, the pressure exerted on the plates depends on the characteristics of the springs used, and it is difficult to obtain a precise tensioning of the thread for a giving setting of the control member. Also, as the force exerted by the control member on the spring increases, actuation of the control member becomes more difficult.

An object of the invention is to provide a device which enables these drawbacks to be obviated, the device according to the invention comprising a lever pivotally mounted about an axis and arranged to act on the shaft to set the clamping of the plates, and a pressure-exerting member movable, by actuation of the control member, along the lever between its axis of pivoting and an end of the lever.

This thread-tension regulating device is particularly useful in sewing machines, and the invention therefore also pertains to a sewing machine incorporating such a device.

The accompanying drawings show, schematically and by way of example, two embodiments of the invention. In the drawings:

FIGS. 4 and 5 are plan and edge elevational views of another washer of FIGS. 1 and 2;

FIGS. 6 and 7 are respectively a plan view and a cross-section along line VII—VII of FIG. 6, of a thread-squeezing disc of the device; and FIG. 8 is a view similar to FIG. 1 of the second embodiment.

Figure 1:
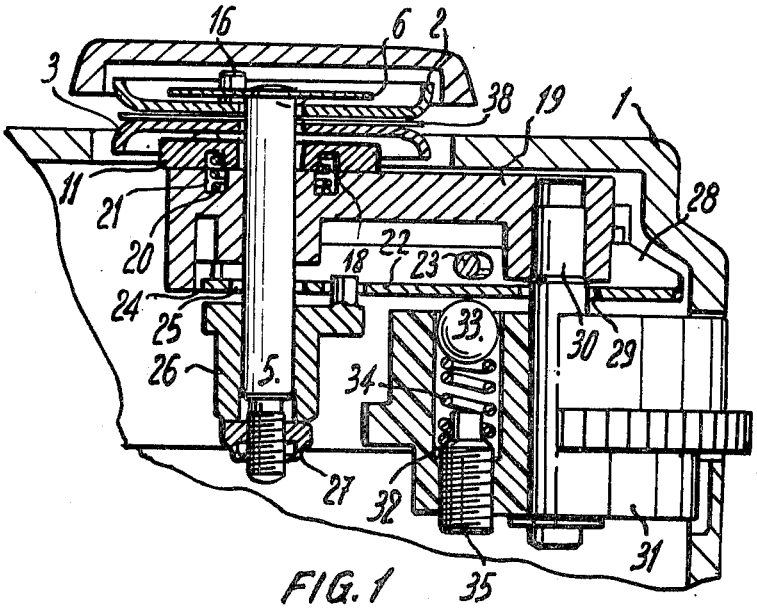
FIG. 1 is a view of the first embodiment, partly in elevation and partly in cross-section along line I—I of FIG. 2.

The thread-tensioning device shown in FIGS. 1–7 is mounted in the upper arm 1 of a sewing machine. It comprises two thread-squeezing discs 2, 3 each having a central hole 4 which is engaged with play on a shaft 5 carrying at its upper end a washer 6. On its inner face, the washer 6 has two diametrally opposed embossments 7, 8 which bear against the upper face of disc 2.

The lower face of disc 3 rests on diametrally opposed embossments 9, 10 on the upper face of another washer 11.

The discs 2, 3 each have holes 12, 13, the washer 6 has notches 14, 15 and the washer 11 has holes 14', 15', in which are engaged pins 16, 17 preventing relative angular movement of the discs 2, 3 and washers 6, 11 and holding the embossments 7–10 of the washers disposed at 90° to one another. Only disc 3 is shown in FIGS. 6 and 7, it being understood that disc 2 is identical thereto.

The lower face of washer 11 has a circular groove 18 and bears on a supporting piece 19 with an interposed coil spring 20 one end of which is lodged in a circular groove 21 of piece 19 whereas its other end is lodged in the groove 18 of washer 11.

A lever 22 of U-shaped transverse cross-section and disposed substantially perpendicular to the shaft 30 of a button 31 for setting the clamping together of discs 2, 3, is pivotally mounted about a pin 23 engaged in a mounting plate 23a.

One arm, 24, of lever 22 has a hole 25 through which passes the lower end of shaft 5 looking at FIG. 1, i.e. the end opposite that on which the discs 2, 3 are held. The lever arm 24 is able to bear against an abutment 26 which is engaged on the lower end of shaft 5 and is adjustable in height on the shaft 5 by means of a nut 27.

The other arm, 28, of lever 22 has a hole 29 receiving the shaft 30 of the button 31 for setting the clamping together of discs 2, 3. This setting button 31 has an eccentric bore 32 in which is housed a ball 33 supported on a coil spring 34 held on a setting screw 35.

By setting the height of the abutment piece 26, one can adjust the inclination of the lever 22 relative to the facing flat face of button 31, i.e. its upper face looking at FIG. 1.

Figure 2:
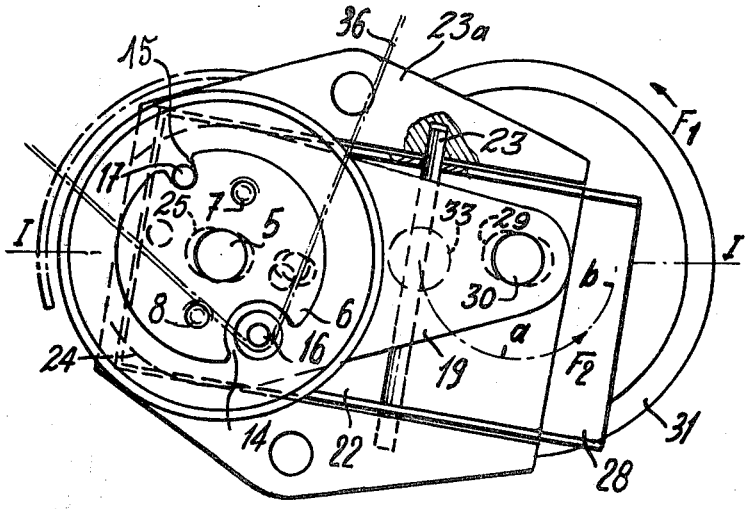
FIG. 2 is a top plan view of the device of FIG. 1, but removed from the casing of the machine in which it is incorporated.
Figure 3:
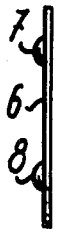
FIG. 3 is an edge elevational view of a washer of FIGS. 1 and 2.

When the lever 22 is held by the abutment 26 parallel to the upper face of button 31, the pressure of spring 34 remains constant during movement of the ball 33 under the arm 28 of lever 22 along arcuate path $F_2$ (see FIG. 2). One thus obtains, when the button 31 is turned in the counter-clockwise direction according to arrow $F_1$ (FIG. 2), a displacement of the ball 33 away from the pivoting axis (pin 23) which produces a progressively increasing downward force on the shaft 5 which is transmitted to the discs 2, 3 to increase the tension of a thread 36 passing between them. This variation of the thread tension is thus obtained for a constant force of the spring 34, and the force needed to move the button 31 is the same for all settings.

When, to the contrary, the arm 28 of lever 22 is inclined to the upper face of button 31 by raising the arm 24 of the lever by adjustment of abutment piece 26, the pressure exerted by ball 33 under the arm 28 of lever 22 increases as it moves along the arcuate path $F_2$. Thus the force transmitted by shaft 5 to press together the discs 2, 3 increases more rapidly than before, because of the progressive increase in the pressure of spring 34. In this instance, the setting force thus depends to a certain degree on the characteristics of the spring 34.

Likewise, when the lever 22 is inclined in the other direction (by lowering of its arm 24), the pressure of spring 34 transmitted to the discs 2, 3 increases less rapidly than when the lever 22 is parallel to the upper face of button 31.

Similar results can be obtained while keeping the arm 28 of lever 22 parallel to the upper face of button 31, by providing a cam track 39 which progressively protrudes under (as shown in FIG. 8) or is progressively recessed in the arm 28 of lever along the arcuate path $F_2$.

In the device of FIG. 1, there is also an optional washer 38 disposed between the discs 2, 3 so as to enable the tension of two threads to be simultaneously adjusted. Also, as the or each thus-tensioned thread is guided about the pin 16 extending through the discs 2, 3, it is pinched between the two discs 2, 3 or between one of the discs 2, 3 and washer 38, as the case may be, and moves along a longer path than in the usual tensioning devices with two discs or flanges which only grip a single thread at their periphery. As a result of this longer path, the device is less sensitive to manufacturing irregularities in the thread, notably its thickness. Further, maintenance of the discs parallel to one another is permanently assured, in particular by the arrangement of the embossments 7 to 10.

In the position shown in FIGS. 1 and 2, the ball 33 is located directly under the pin 23 forming the pivoting axis of lever 22, so that the arm 24 of lever 22 exerts no pressure on the abutment 26. When the button 31 is turned counter-clockwise according to arrow $F_1$ (FIG. 2), the ball 33 moves under the arm 28 of lever 22 along the arcuate path $F_2$ and hence acts with a progressively increasing force on the stop 26 as it moves away from the pivoting axis of lever 22. Thus, the tension on a thread 36 running between the discs 2, 3 is increased progressively by turning the button 31 in the counter-clockwise direction through 180° from the position shown in FIGS. 1 and 2.

The coil spring 20 permanently holds the discs 2, 3 against one another, or against the washer 38, with a sufficient minimum pressure to enable spooling of a bobbin, for example, even when the ball 33 is located under the pivoting pin 23 of lever 22.

FIG. 8, in which like reference numerals designate the same parts as before or their equivalents, shows a device in which the lower disc 3 bears on embossments 9, 10 provided on the support 19 (instead of on the washer 11), this support 19 forming part of the casing of the upper arm 1 of a sewing machine. The coil spring 20 is disposed between the outer disc 2 and a cover 40 mounted on the upper arm 1 and covering the outer disc 2. The lever arm 28 has, along the arcuate track $F_2$ described by the ball 33 during actuation of the button 31, a progressively protruding cam track so that even when the arm 28 of lever 22 is held parallel to the facing face of button 31, the tension of thread 36 produced by discs 2, 3 increases rapidly when the button 31 is turned counterclockwise according to arrow $F_1$. However, with an adjustment of the nut 27 substantially as illustrated in FIG. 8, when the button 31 is turned, the lever 22 pivots slightly and the cam track 39 remains parallel to the upper face of button 31, thus providing a progressive regulation of the thread tension for a constant force exerted by the spring 34. The cam track 39 could alternatively be degressive, i.e. progressively inset in the lever arm 28.

Numerous other variations of the described embodiments may be envisaged. Hence, the lever arm 28 of lever 22 could form an angle with the arm 24 instead of being in extension of it. Also, the button 31 could be replaced by a sliding cursor. And the coil spring 20 could even be disposed between the cover 40 and washer 6.

We claim:

1. A thread-tension regulating device comprising at least two thread-squeezing plates and means for controlling the clamping together of said plates, said control means including a pressure-transmission lever pivotally mounted for limited angular displacement about a fixed axis, a pressure-exerting member movable along said lever between its axis and one end of said lever, a control member for moving said pressure-exerting member, and transmission means subject to the action of said lever for applying an increasing clamping force on said plates as said pressure-exerting member is moved towards said one end of said lever.

2. A device according to claim 1, in which the pressure-exerting member moves in a plane parallel to the lever.

3. A device according to claim 1, in which the pressure-exerting member moves in a plane inclined to the lever.

4. A device according to claim 1, in which the lever has a cam track along which the pressure-exerting member moves.

5. A device according to claim 1, in which the pressure-exerting member is urged by a spring of adjustable force.

6. A device according to claim 1, comprising at least one thread-guiding first pin extending through eccentric holes in the plates parallel to the shaft.

7. A device according to claim 6, in which the plates pass about said shaft with play, and comprising a second pin extending through eccentric holes in the plates parallel to the first pin, the first and second pins cooperating to hold the plates in alignment.

8. A device according to claim 6, in which the plates are disposed between two bearing pieces each having two diametrally opposed embossments on a face facing the plates, said pin holding said pieces in a relative position in which the embossments are spaced apart angularly by substantially 90° to one another.

9. A device according to claim 8, in which at least one of said bearing pieces is a washer biased to hold the plates together by a spring acting against a support.

10. A device according to claim 8, in which the plates are disposed between two supports, one of the supports formng one of said bearing pieces and including a spring acting against the other support to bias the plates towards said one support.

11. A device according to claim 10, in which said biasing spring acts directly between said other support and one of the plates.

12. A device according to claim 10, in which said one support is part of the free arm of a sewing machine, and said other support is a cover mounted on said free arm.

13. A device according to claim 1, incorporated in a sewing machine.

14. A device for regulating the tension of a thread comprising at least two thread-squeezing plates disposed on a shaft, a control member controlling the clamping together of the plates, a lever pivotally mounted about an axis and acting on the shaft to set the clamping of the plates, a pressure-exerting member movable along said lever between its pivotal axis and an end of said lever in response to actuation of said control member, an adjustable force spring urging said pressure-exerting member against said lever, a rotatable setting button including an eccentric bore, said pressure-exerting member mounted in said eccentric bore substantially parallel to the axis of rotation of said button, said lever including a face against which said pressure-exerting member remains in contact during a rotation of at least 180° of said button corresponding to movement of said pressure-exerting member between a first position adjacent said pivotal axis of said lever and a second position diametrically opposed to the first position in relation to the pivoting axis of said setting button.

15. A device according to claim 14, in which the pressure-exerting member moves along an arm of the lever which is perpendicular to the pivoting axis of the setting button.

16. A device according to claim 14, in which the pressure-exerting member moves along an arm of the lever which is inclined to the pivoting axis of the setting button.

* * * * *